United States Patent [19]

Lueneburger

[11] Patent Number: 4,803,451

[45] Date of Patent: Feb. 7, 1989

[54] TECHNIQUE FOR CALIBRATING AN ELECTROMAGNETIC RELAY

[75] Inventor: Klaus Lueneburger, Berlin, Fed. Rep. of Germany

[73] Assignee: Siemens Aktiengesellschaft, Berlin and Munich, Fed. Rep. of Germany

[21] Appl. No.: 55,563

[22] Filed: May 28, 1987

[30] Foreign Application Priority Data

Jun. 23, 1986 [DE] Fed. Rep. of Germany ..... 3620941

[51] Int. Cl.[4] ..... H01F 7/13

[52] U.S. Cl. ..... 335/273; 335/132; 335/270

[58] Field of Search ..... 335/270, 273, 274, 276, 335/219, 80, 81, 86, 128, 132

[56] References Cited

U.S. PATENT DOCUMENTS

| | | | |
|---|---|---|---|
| 2,332,139 | 10/1943 | Finnegan | 335/273 X |
| 3,174,008 | 3/1965 | Mishelevich | 335/154 |
| 4,206,432 | 6/1980 | Altorfer et al. | 335/106 |

FOREIGN PATENT DOCUMENTS

| | | |
|---|---|---|
| 950490 | 10/1956 | Fed. Rep. of Germany . |
| 1232638 | 1/1967 | Fed. Rep. of Germany . |
| 2059390 | 6/1972 | Fed. Rep. of Germany . |
| 0125199 | 11/1984 | Fed. Rep. of Germany . |

*Primary Examiner*—George Harris

*Attorney, Agent, or Firm*—John Francis Moran

[57] ABSTRACT

The response and extinction voltage of a relay are adjusted by displacing an armature, on the one hand, and pole plates, on the other hand, parallel to each other. The extent of each opposing pole face is varied without varying the air-gap distance. This method of calibration is of particular advantage in relation to a reed relay with a bridge contact.

15 Claims, 3 Drawing Sheets

TECHNIQUE FOR CALIBRATING AN ELECTROMAGNETIC RELAY

BACKGROUND OF THE INVENTION

This invention relates to a calibration technique for setting the switching characteristics of an electromagnetic relay of the type including at least one flat pole plate and an armature that is resilient, or resiliently mounted, and that opposes the pole plate with overlapping pole faces while leaving a prescribed air gap are accomodated in a housing. The present invention also relates to a relay having a construction that can be readily calibrated.

In relays with a resiliently mounted armature, it is usually necessary to control adjustably the spring force exerted on the armature by bending the spring in order to obtain the desired relay characteristics, usually the voltage levels at which the relay responds or falls off, that is, within a desired range and hence compensate for every possible deviation in manufacturing tolerance. Bending an armature-restoration spring, however, is not only expensive but will also permanently change the spring properties, which can for example affect the life of the relay.

When, on the other hand, the armature simultaneously serves as a contact element, as in the case with reed contacts, the response levels can be adjusted only to a limited extent by bending the armature because bending also changes the inter-contact distance, with accordingly undesirable results. If the armature and pole plate also happen to be accommodated in a closed contact space, bending adjustment is in any case only possible with specific designs and by specific methods. Thus, with a multiple contact of the type disclosed in German Patent Document OS No. 2 059 390, the armature and its bearing spring are no longer accessible once the contact space has been closed. It is, however, only after the contact has been manufactured and inserted into a relay that response and extinction levels can be controlled and evaluated sufficiently to compensate for deviations in manufacturing tolerances.

SUMMARY OF THE INVENTION

An object of the present invention is to provide a calibration technique that may also be employed with armature contacts and within closed contact spaces.

A related object is to provide for the calibration of the characteristics of a relay after it has been assembled and will accordingly make it possible to take all deviations in manufacturing tolerances into consideration.

A further object of the calibration technique of the invention is to establish the characteristics of the relay, especially its response and extinction voltage, within a narrow range.

Another object of this invention is to provide a relay that is appropriate for use with the calibration method.

The foregoing objects are attained in accordance with the invention and in a calibrating method of the aforesaid type in that initially only either the pole plate or the armature is secured in the housing, whereas the other element is positioned in a guide slot in the housing while maintaining the prescribed air gap, although such that it can slide back and forth parallel with the pole faces, in that the overlap of the pole faces is varied by discontinuously displacing the sliding element while the different characteristics relating to the relay's response and drop are measured, and in that the sliding element is secured in the housing when the characteristics are within a prescribed range.

Thus, neither the armature nor the spring that functions as a mount for the armature are bent in the method utilizing the principles of the invention, but the pole faces are varied without changing the size of the air gap. Since the pole plate or pole plates and the armature are displaced parallel in guide slots in accordance with the invention, specifically along the length of the pole plates or armature, this type of calibration can also be carried out in a closed, although not completely sealed off, contact space. Guide slots of this type can also be sealed off later in a simple manner.

The method of the invention may be employed to advantage in a relay wherein both pole plates are positionend in a common plane with their free ends facing each other and separated and the armature is positioned approximately parallel and opposite the free ends of both pole plates, creating an area overlapping each. In this case, either one or both pole plates or the armature is initially positioned in a practical way such that it can slide back and forth in the housing, is displaced in the foregoing manner subsequent to assembly, and is not secured in place until the desired characteristics have been achieved.

In one illustrative embodiment of the previously described bridge-contact relay, the armature is mounted on a resilient support in the guide slot in the housing in such a way that it can slide back and forth in relation to the two pole plates and is secured in place once the desired characteristics have been attained. The armature or its support is preferably positioned in the housing in such a way that it can slide only parallel to its own longitudinal axis and that of the pole plates. Thus, the overlap between the armature and the first pole plate will always increase while the overlap between the armature and the second pole plate decreases or vice versa. It is, however, also contemplated for the armature to slide back and forth across the longitudinal axis of the pole plates, whereby the overlaps with the two pole plates would increase and decrease simultaneously.

In a particularly preferred illustrative embodiment of a relay in accordance with the invention, first, the pole plate or plates are embedded in one component of the housing, second, the resilient support that the armature is mounted on is inserted in a groove defined between the first component of the housing and another component of the housing when the two components are brought together, third, a spool winding is mounted over the now adjacent housing components, fourth, the armature is finally positioned in relation to the pole plates by displacing the support along the groove with the relay's response and extinction voltages being continuously measured, and, finally, the armature is secured in place, once the desired response or drop voltage has been attained, by pouring a liquid plastic in.

A relay for use with the method in accordance with the invention preferably has, first, a housing in the form of a two-component spool with a contact space created inside the spool by trough-shaped recesses in both components of the spool, second, two pole plates embedded facing each other in one place in one component of the spool with their free ends in the contact space and a flat armature mounted on a resilient support in the contact space, and, finally, a winding mounted over both components of the spool. Both components of the spool are made out of plastic. A groove is left in at least two facing sides of the contact space in the vicinity of the separation between the two components of the spool, the armature support is positioned in the groove at a prescribed distance from and parallel with the plane of the pole plates but with play left in relation to its own major plane, and the armature support is secured in place in the groove by additional means.

In one practical illustrative embodiment, the armature support is in the form of a frame and is positioned and secured in a continuous groove that extends in at least one direction beyond the end of the support. The armature is secured to a tongue that extends in from one side of the frame. The armature in one modified embodiment, however may be secured by only part of a frame or by only one web. The armature support may also have an integrated adjusting web extending from the support toward the outside of the spool and accessible from outside at least before the support has been secured.

BRIEF DESCRIPTION OF THE DRAWING

Features of the invention and additional objects of the invention will be more readily appreciated and better understood by reference to the following detailed description which should be considered in conjunction with the drawing.

DETAILED DESCRIPTION

Figure 1:
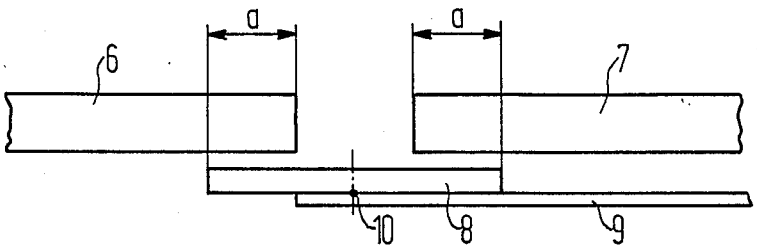
FIGS. 1 and 2 are simple schematic illustrations of a calibration method in accordance with the invention.
Figure 2:
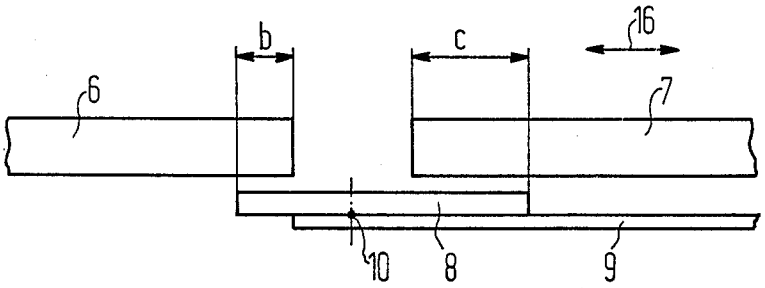

FIGS. 1 and 2 schematically illustrate the manner in which a relay is calibrated in accordance with the invention. In this type of relay two pole plates 6 and 7 are accommodated in the same plane within a housing, with an armature 8 mounted, also inside the housing, parallel with both plates on a resilient armature support 9. The bridge armature 8 illustrated in FIG. 1 is positioned such that it overlaps the ends of both pole plates 6 to the same extent a, assuming that both parts are equal in width. leaving equal air-gap areas between armature 8, on the one hand and each pole plate 6 and 7, on the other. Even when the air-gap areas have been precisely established, however, the response and extinction characteristics, the voltages, that is, of the relay may differ due to variations in manufacturing tolerance. To confine these characteristics to a prescribed narrow tolerance, then, armature 8 is displaced in a straight line on its support 9 as indicated by bidirectional arrow 15 in the housing so that, even though the air gap distance from the pole plates remains constant, the areas of overlap in relation to the plates will increase or decrease. The direction of displacement is indicated by the double-headed arrow 16 in FIG. 2. The armature 8 in the example illustrated in FIG. 2 has been displaced to the right of the position illustrated in FIG. 1, and the extent b of overlap between armature 8 and pole plate 6 is now shorter than the extent a illustrated in FIG. 1, whereas the extent a of overlap between armature 8 and pole plate 7 is now longer than a. Also, pole plate 6 may be displaced as indicated by arrow 17. Thus, the response voltage for the system illustrated in FIG. 2 is higher and the extinction voltage lower. It is, however, also possible to individually displace the two pole plates instead of the armature wherein the displacement of arrows 16 and 17 occurs instead of arrow 15 and accordingly arrive at separate and independent desired levels.

Figure 3:
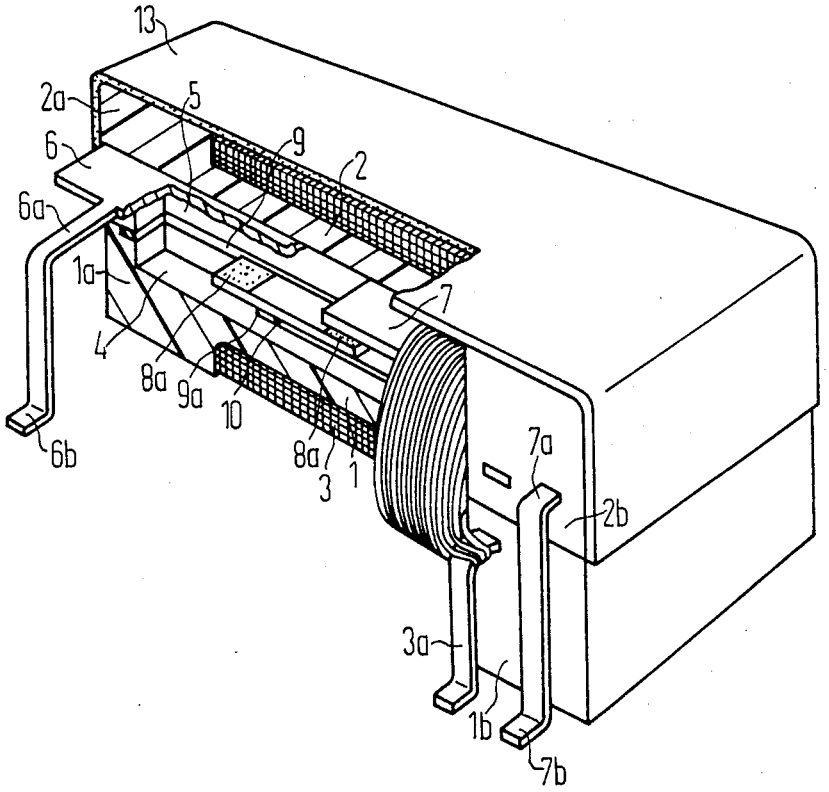
FIG. 3 is a perspective, partly sectional, view of an electromagnet relay for use with the calibration method in in accordance with the invention.
Figure 4:
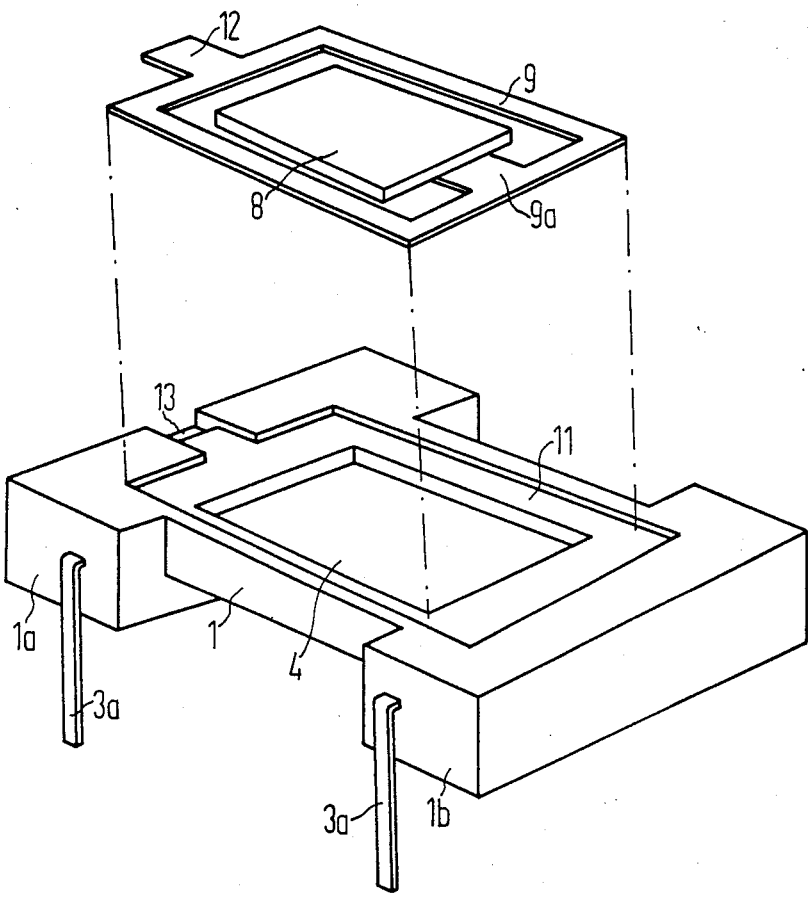
FIG. 4 illustrates an armature support with an armature and one component of the housing of the relay depicted in FIG. 3 and FIGS. 5 and 6 are respective side view and top view of another embodiment of an armature support and armature

A relay that may be employed with the foregoing calibration method is illustrated in FIGS. 3 and 4. The relay illustrated in FIG. 3 has a two-component base, with its lower component 1 and its upper component 2 each being approximately in the shape of half of a bowl and fitting together in such a way as to contain a spool with a winding 3 mounted on it. Lower base component 1 has a trough-shaped recess 4 and upper base component 2 has a matching trough-shaped recess 5. The two recesses together define a contact space. Embedded in upper base component 2 are two pole plates 6 and 7 with their free ends separated to a prescribed extent and extending into contact space 4 and 5. Pole plates 6 and 7 may also each be secured with their longitudinal edges in the walls of the contact space. They could also be plugged in instead of embedded.

Inside the flange 2*a* of base component 2 pole plate 6 has a connection element 6*a* that is shaped into it along its major plane and at an angle to its major axis. Connection element 6*a* is bent down at a right angle toward the connection plane of the relay. It may at that point either take the form of a conventional contact pin or be shaped into a flat contact 6*b* as illustrated in FIG. 3. The relay is accordingly appropriate for surface mounting (SM). A similar connection 7*a* with a flat contact 7*b* is shaped onto pole plate 7 in the vicinity of flange 2*b*. Coil 3 is connected through a spool-connection pin 3*a* in each flange 1*a* and 1*lb* in lower housing component 1. Pins provided on either or both sides of the relay as desired.

Accommodated in contact space 4 and 5 is an armature 8. Armature 8 is secured parallel with, at a prescribed contact distance from, and overlapping pole plates 6 and 7. Thus, when the relay is excited, armature 8 will be bridging both pole plates both magnetically and electrically. For this purpose, it has a contact coating 8*a* in each overlap. Similar contact coatings are also applied to the pole plates. Armature 8 is mounted on a support 9 in the form of a frame, which will be specified later herein with reference to FIG. 4. Armature 8 is secured to support 9 by a spot weld 10. Other means of attachment are also possible if desired.

The design and disposition of armature support 9 in relation to part of the base is schematically illustrated in FIG. 4. Trough-shaped recess 4, which constitutes the bottom of the contact space, is located in the midsection of lower base component 1. Frame-shaped armature support 9 is accommodated in base component 1 in a frame-shaped offset 11. Offset 11 is approximately half as deep as armature support 9, which is made out of a resilient material, is thick. Since there is a corresponding offset in upper housing component 2, which is not illustrated in FIG. 4, a frame-shaped groove is left between the two housing components 1 and 2 when they are fitted together. This groove accommodates and secures armature support 9. A tongue 9*a*, which is what actually supports armature 8, extends in from one transverse web of frame 9.

Since, as will be evident from FIG. 4, the offset 11 in base components 1 and 2 is longer than the frame of armature support 9, support 9 can still be displaced within the plane that it is secured in even after the housing components have been fitted together, and the areas of the armature that face each pole plate 6 and 7 can be varied as illustrated in FIGS. 1 and 2 in order to equilibrate the response sensitivity of the relay. To make it possible to slide armature support 9 back and forth, it has an outwardly projecting adjusting web 12 at one end that may be activated from outside in a corresponding recess 13 in base 1 or 2. Once the relay has been calibrated, opening 13 may be sealed off with a quantity of molten material or adhesive for example, simultaneously securing armature support 9 in place.

Figure 5:
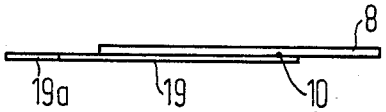
Figure 6:
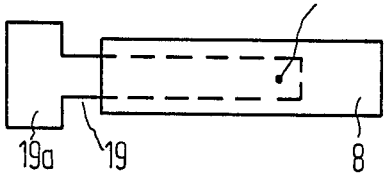

A variant of the armature support is illustrated from the side and from the top in FIGS. 5 and 6. Armature support 19 is strictly in the form of a unilaterally tensioned leaf spring. The tensioned end 19*a* of armature support 19 is in the form of a T to increase the tension. It is secured in a matching, not shown, groove between the two base components 1 and 2. The point of attachment between the armature and armature support in this version as well as in the form of a spot weld. In this case the end 19*a* of armature support 19 functions as an adjustment web and is accessible from outside once the two housing components have been fitted together, so that the armature can be displaced as previously described herein and the relay calibrated. To ensure a definite position on the part of the armature and hence a definite response on the part of the relay in operation the armature support 19 in this illustrative embodiment is, similar to the armature support 9 in the embodiment previously specified herein, secured in place in the adjustment or of a molten material.

The relay is simple to manufacture because all of its metal parts are flat stampings and do not have to be bent. The subsequent bending of connection elements 6*a*, 7*a*, and 3*a* outside the base can be ignored in this conext. Pole plates 6 and 7 are accordingly injected in the form of flat stampings into upper housing component 2, whereas coil-connection elements 3*a* are injected into lower housing component 1. Once the trough-shaped recesses 4 and 5 in the two components have been cleaned out, the components are fitted together with armature support 9 or 19 and its welded-on armature 8 is accommodated between them. Armature 8 is accordingly kept at its prescribed contact distance or air-gap distance from the pole plates just by fitting the two components together. Once a spool winding 3 has been mounted the armature support is slid back and forth as previously described to attain calibration. This is done in a practical way in small increments with the response and drop voltages of the relay always being measured with appropriate instruments. Once the levels are within the desired range, the relay has been calibrated and the armature support can be secured in place by cementing, say, the adjusting web.

A flux return in the form of a ferromagnetic foil 13 is also wrapped around the upper housing component. A final extrusion-coating or immersion process can if necessary secure the iron foil and spool and reliably seal off the inside.

The armature in the described and illustrated embodiment functions as a bridge contact and according needs no connection of its own. Since in any case, however, the contact with one of the pole plates in this type of armature mount initially closes and one contact likewise initially opens, the relay may also be provided with either a precedence or a consecutive contact. In this case the two pole plates 6 and 7 are simply connected to be electrically conductive by welding on a contact layer for example. The armature will, in this case, also need its own connection element, whereas one of the pole-plate connection elements may be eliminated. The armature-connection element may, for example, be injected into lower housing component 1, with an end projecting out on the inside connected to the armature support by welding for example. In this consecutive-contact design then, contact layers with different properties will then be provided in a known way between the armature and the pole plates.

Finally, it should be noted that, in addition to or instead of the armature, the pole plates may also be mounted in such a way that they can slide back and forth in the housing. It would for example also be conceivable to embed the armature along with its support in one housing component and to position the pole plates in a groove at the plane separating the two housing components and secure the plates later.

There has thus been shown and described a calibration technique and relay configurations which fulfill all the objects and advantages sought therefor. Many changes, modifications, variations and other uses and applications of the subject invention will, however, become apparent to those skilled in the art after considering this specification and the accompanying drawing which disclose the preferred techniques and embodiments therefore. All such changes, further modifications, variations and other uses and applications which do not depart from the spirit and scope of the invention are deemed to be covered by the invention which is limited only by the claims which follow.

What is claimed is:

1. A method for calibrating the switching characteristics of an electromagnetic relay including at least one flat pole plate and an armature being resiliently mounted, and opposing the pole plate with overlapping pole faces while leaving a prescribed air gap are accommodated in a housing, the method comprising the steps of initially securing at least one element of a group including the at least one pole plate and the armature in the housing, positioning at least one unsecured element in a guide slot in the housing while maintaining a prescribed air gap in a manner wherein it can slide back and forth parallel with the pole faces; varying the overlap of the pole faces by incremently displacing the sliding element while measuring the different characteristics relating to the relay's response and drop; and securing the sliding element in a fixed position in the housing when the characteristics are within a prescribed range.

2. A method according to claim 1, wherein the electromagnetic relay includes two flat pole plates further comprising positioning both pole plates in a common plane with their free ends facing each other and separated, and positioning the armature approximately parallel and opposite the free ends of both pole plates, defining an area overlapping each, initially positioning at least one element among both pole plates and the armature such that is can slide back and forth in the housing and displacing at least one of the elements and securing in accordance with the desired characteristics of the relay being attained.

3. A method according to claim 1, wherein first, at least one pole plate is embedded in one component of the housing; second, the resilient support that the armature is mounted on, is inserted in a groove left between the first component of the housing and another component of the housing when the two components are brought together; third, a spool winding is mounted over the now adjacent housing components; fourth, the armature is finally positioned in relation to the pole plates by displacing the support along the groove with the relay's response and extinction voltages being continuously measured; and, finally, the armature is secured in place, once the desired response has been attained, by pouring a liquid plastic in.

4. A method according to claim 2, further comprising mounting armature on a resilient support in a guide slot in the housing so that it can slide back and forth in relation to the two pole plates and is secured in place once the desired characteristics have been attained.

5. A method according to claim 2, wherein first, at least one pole plate is embedded in one component of the housing; second, the resilient support that the armature is mounted on, is inserted in a groove left between the first component of the housing and another component of the housing when the two components are brought together; third, a spool winding is mounted over the now adjacent housing components; fourth, the armature is finally positioned in relation to the pole plates by displacing the support along the groove with the relay's response and extinction voltages being continuously measured; and, finally, the armature is secured in place, once the desired response has been attained, by pouring a liquid plastic in.

6. A method in accordance with claim 3, further comprising displacing the armature along both pole plates.

7. A method according to claim 3, wherein the armature slides back and forth across the pole plates.

8. A method according to claim 4, wherein the armature slides back and forth across the pole plates.

9. A method according to claim 4, wherein first, at least one pole plate is embedded in one component of the housing; second, the resilient support that the armature is mounted on, is inserted in a groove left between the first component of the housing and another component of the housing when the two components are brought together; third, a spool winding is mounted over the now adjacent housing components; fourth, the armature is finally positioned in relation to the pole plates by displacing the support along the groove with the relay's response and extinction voltages being continuously measured; and, finally, the armature is secured in place, once the desired drop voltage has been attained, by pouring a liquid plastic in.

10. A relay adapted for calibration, the relay comprising a housing in the form of a two-component spool forming space inside the spool and a groove having trough-shaped recesses in both components of the spool; two pole plates embedded facing each other in one place in one component of the spool with their free ends in the contact space and a flat armature mounted on a resilient support in the contact space; a winding mounted around both components of the spool; both components of the spool being plastic, the groove is formed by at least two facing sides of the contact space in the vicinity of the separation between the two components of the spool, an armature support is positioned in the groove at a prescribed distance from and parallel with the plane of the pole plates but with play left in relation to its own major plane; and the armature support is secured in place in the groove by additional means.

11. A relay according to claim 10, wherein the armature support is shaped like a tongue with one end secured in a groove of the same width and the armature is mounted on its other end inside the contact space.

12. A relay according to claim 10, wherein the armature support is in the form of a frame and is positioned and secured in a continuous groove that extends in at least one direction beyond the end of the support and the armature is secured to a tongue that extends in from one side of the frame.

13. A relay in accordance with claim 10, wherein the armature support has an integrated adjusting web extending from the support toward the outside of the spool and accessible from outside at least before the support has been secured.

14. A relay in accordance with claim 11, wherein the armature support has an adjusting web extending from the support toward the outside of the spool and accessible from outside at least before the support has been secured.

15. A relay in accordance with claim 12, wherein the armature support has an integrated adjusting web extending from the support toward the outside of the spool and accessible from outside at least before the support has been secured.

* * * * *